US011224880B1

(12) United States Patent
Almalki et al.

(10) Patent No.: US 11,224,880 B1
(45) Date of Patent: Jan. 18, 2022

(54) LABORATORY FLASK HOLDER AND DISPENSING SYSTEM

(71) Applicant: King Abdulaziz University, Jeddah (SA)

(72) Inventors: Nawal Ghurmullah Hassan Almalki, Jeddah (SA); Salah Eldin Mohamed Abu Aba, Jeddah (SA)

(73) Assignee: KING ABDULAZIZ UNIVERSITY, Jeddah (SA)

( * ) Notice: Subject to any disclaimer, the term of this patent is extended or adjusted under 35 U.S.C. 154(b) by 0 days.

(21) Appl. No.: 17/130,166

(22) Filed: Dec. 22, 2020

(51) Int. Cl.
*B01L 9/00* (2006.01)
*B01L 3/00* (2006.01)

(52) U.S. Cl.
CPC ..... *B01L 3/52* (2013.01); *B01L 9/00* (2013.01); *B01L 2200/026* (2013.01); *B01L 2200/0689* (2013.01); *B01L 2200/147* (2013.01); *B01L 2300/027* (2013.01); *B01L 2300/042* (2013.01)

(58) Field of Classification Search
CPC ..... A47F 5/12
See application file for complete search history.

(56) References Cited

U.S. PATENT DOCUMENTS 3,868,047 A * 2/1975 Bersano ..... C12L 11/00 222/166
D440,496 S * 4/2001 Adam ..... D7/622
6,575,337 B1 * 6/2003 Malavear ..... A47J 36/34 222/166
6,889,945 B2 * 5/2005 McCall ..... A47G 23/0241 222/144
7,393,112 B1 * 7/2008 Zell ..... A47G 23/0241 362/101
9,856,128 B2 1/2018 Bishel
10,203,235 B1 2/2019 Gottfried
2002/0046817 A1 * 4/2002 Last ..... E04H 4/101 160/133
2013/0074978 A1 * 3/2013 Rasmussen ..... B67D 1/0443 141/2

FOREIGN PATENT DOCUMENTS

CA 2773338 10/2013
CN 209306209 8/2019
TW 2014220405 3/2015

* cited by examiner

*Primary Examiner* — Paul S Hyun
(74) *Attorney, Agent, or Firm* — W&C IP

(57) ABSTRACT

A laboratory flask holder, comprising a holder portion configured to receive a laboratory flask, a frame connected to the holder portion, wherein the holder portion is configured to pivot about the frame such that a liquid may be dispensed from the laboratory flask without moving the frame, a temperature sensor arranged on the holder portion configured to determine a temperature of a liquid in the laboratory flask, and a display for providing an indication of the temperature of the liquid is provided. Methods of using the flask holder and a dispensing system are also provided.

7 Claims, 4 Drawing Sheets

LABORATORY FLASK HOLDER AND DISPENSING SYSTEM

FIELD OF THE INVENTION

The invention is generally related to a laboratory flask holder configured to monitor the temperature of a fluid contained therein and a system for the dispensing of predetermined volumes of fluid.

BACKGROUND OF THE INVENTION

Laboratories across the world sterilize culture media by placing flasks containing the media in an autoclave which brings the flask to a temperature exceeding 120° C. After sterilization, researchers generally do not know the temperature of the media prior to pouring it into petri dishes for cell culture purposes. When using agar-containing media, the media begins to solidify when the temperature reaches room temperature. To avoid this issue, researchers often place flasks containing media in a water bath to maintain a higher temperature. However, this method may lead to evaporation and contamination in some poured dishes. Further, carrying hot flasks and testing the temperature by touching the flask leads to pain in the hands. Other issues with prior cell culture methods include the risk of dropping flasks when pouring media, e.g. in a laminar flow cabinet, due to some imbalance. This leads to wasted time for cleaning and lost media. In addition, most researchers rely on the eye only to determine the amount of the media in each plate thus leading to disproportionate amounts of poured media.

New flask stabilization and dispensing systems are needed to address the aforementioned problems.

SUMMARY

An aspect of the disclosure provides a flask holder, comprising a holder portion configured to receive a laboratory flask, a frame connected to the holder portion, wherein the holder portion is configured to pivot about the frame such that a liquid may be dispensed from the laboratory flask without moving the frame, a temperature sensor arranged on the holder portion configured to determine a temperature of a liquid in the laboratory flask, and a display for providing an indication of the temperature of the liquid. In some embodiments, the holder portion is formed from an expandable material. In some embodiments, an inner surface of the holder portion comprises silicone. In some embodiments, the frame is formed from metal. In some embodiments, the temperature sensor is a liquid crystal temperature sensor and the display comprises a color indicator. In some embodiments, the display comprises LED lights. In some embodiments, the holder further comprises a handle arranged on the holder portion to aid a user in tilting the holder portion.

Another aspect of the disclosure provides a dispensing system, comprising a connector configured for attachment to a neck of a laboratory flask, a measuring chamber fluidly connected to the connector, a valve arranged between the connector and the measuring chamber configured to releasably seal the fluid contained within the laboratory flask, and an adjustable cap arranged on the chamber at an end opposite the connector configured to releasably seal the fluid contained within the measuring chamber. In some embodiments, the measuring chamber is configured to contain at least 30 ml of fluid. In some embodiments, the valve is a one way valve.

Another aspect of the disclosure provides a method of pouring culture medium, comprising placing a flask containing heated culture medium into a flask holder according to claim 1; attaching a dispensing system as described herein to a neck of the flask, when the culture medium reaches a predetermined temperature, tilting the flask within the flask holder;

opening the valve to allow a predetermined volume of culture medium to enter the measuring chamber; closing the valve; and opening the adjustable cap to pour the predetermined volume of culture medium.

DETAILED DESCRIPTION

Embodiments of the disclosure provide a laboratory flask holder that monitors the temperature of culture media prior to pouring and stabilizes the flask when pouring the media into petri dishes.

A variety of laboratory flasks are compatible with the devices and systems as described herein. A "laboratory flask" generally refers to a container having a wider vessel "body" and a narrower tubular section at the top called a "neck" which has an opening at the top. Laboratory flask sizes are specified by the volume they can hold, typically in metric units such as milliliters or liters. Typical flask sizes include 50, 100, 250, 500, and 1000 ml flasks. Laboratory flasks have traditionally been made of glass, but can also be made of plastic.

Figure 1:
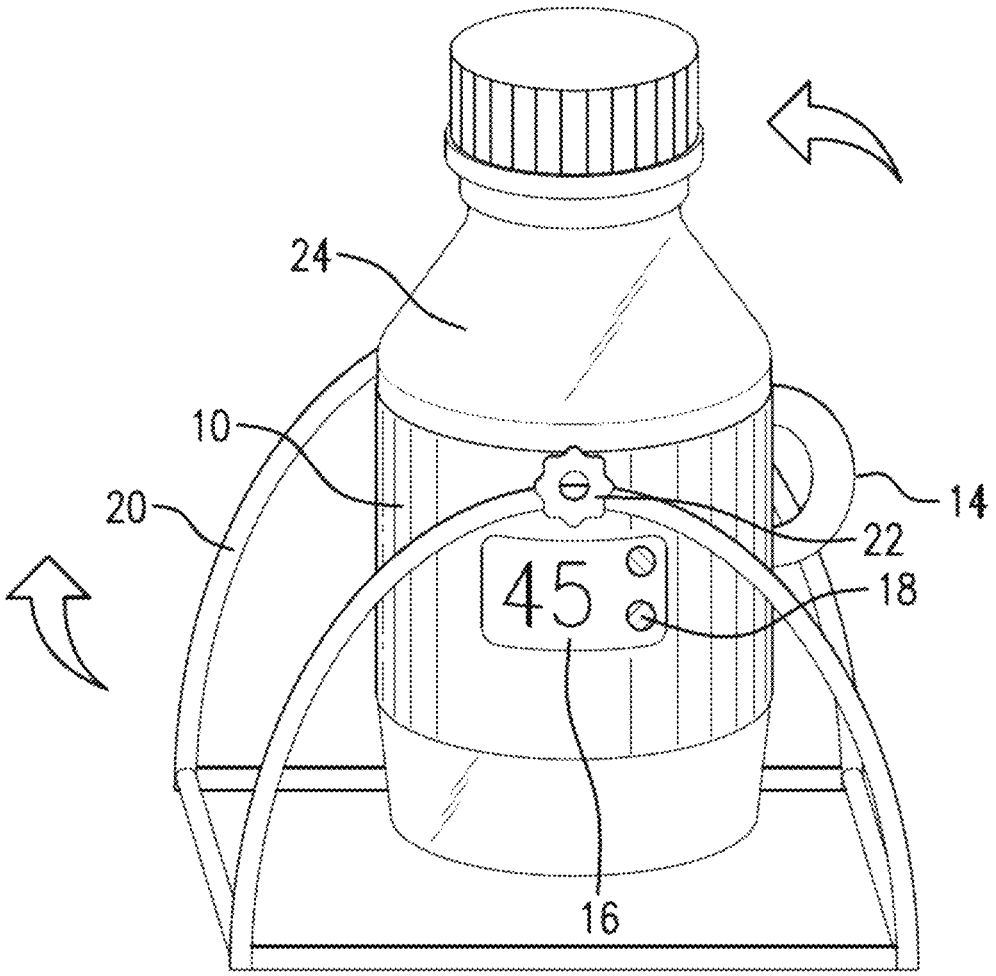
FIG. 1. A flask holder according to some embodiments of the disclosure.

With reference to FIG. 1, the flask holder may comprise a holder portion 10 configured to receive a laboratory flask 24, a frame 20 connected to the holder portion 10, wherein the holder portion 10 is configured to pivot about the frame 20 at a pivot point 22 such that a liquid may be dispensed from the laboratory flask without moving the frame 20, a temperature sensor 16 arranged on the holder portion 10 configured to determine a temperature of a liquid in the laboratory flask 24, and a display 18 for providing an indication of the temperature of the liquid. In some embodiments, a handle 14 is provided on the holder portion 10 to aid a user in tilting the flask contained within the holder portion 10.

The holder portion receives and holds the flask in place. In some embodiments, the holder portion is formed from an expandable material having a cylindrical shape configured to surround the body of a flask. When a flask is not present, the holder portion may have a diameter that is less than the diameter of the flask. For example, depending on the size of the flask intended to be used with the holder, the holder portion may have an internal diameter of about 3-30 cm. When the flask is inserted, the material expands to accommodate the flask and the friction between the holder portion and the flask holds the flask in place. The inner surface 12 of the holder portion may comprise silicone to further secure the flask within the holder portion. Suitable materials that may comprise the holder portion include, but are not limited to, rubber or a silicone O ring attached to the body of the holder.

In other embodiments, the holder portion is formed from a more rigid material, e.g. metal or plastic, and includes a lower portion configured to support the bottom of a flask.

Figure 2A:
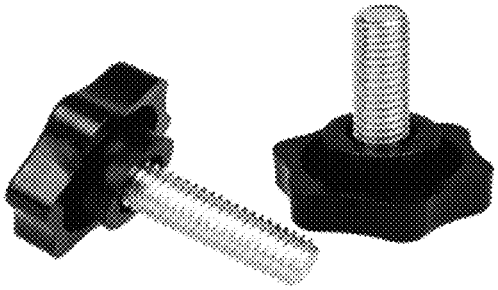
FIGS. 2A-B. Picture of (A) tension screws or (B) holding brake useful at a pivot point according to some embodiments of the disclosure.
Figure 2B:
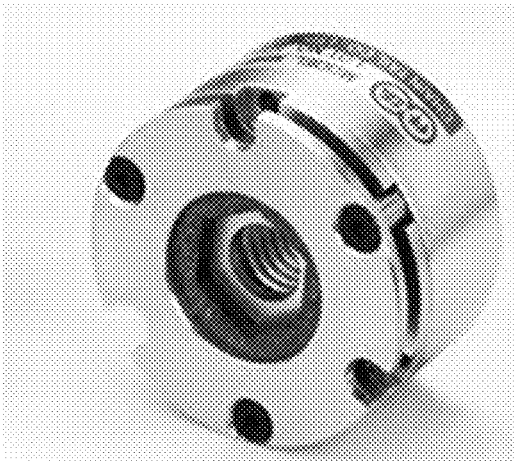

The frame is configured for placement on a surface, such as a laboratory benchtop, and provides stability to the holder portion. The frame may be formed from a rigid material such as metal or plastic. The holder portion pivots about the frame at a pivot point 22 in order to tilt the flask for pouring. With reference to FIG. 2, in some embodiments, the pivot point 22 comprises a tension screw (also known as a star screw) to control the casting/pouring angle (FIG. 2A). In some embodiments, the pivot point 22 comprises a holding brake to control the casting/pouring angle (FIG. 2B).

In some embodiments, the holder is configured such that the holder portion is positioned about 10 cm or more (e.g. 10-30 cm) above the surface on which the holder is placed.

Figure 3:
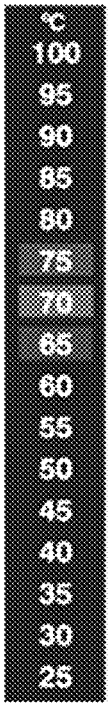
FIG. 3. Picture of a liquid crystal temperature sensor according to some embodiments of the disclosure.

A temperature sensor 16 is provided on the flask holder to monitor the temperature of the flask and a liquid contained therein. With reference to FIG. 3, in some embodiments, the temperature sensor comprises a commercially available liquid crystal thermometer (also known as a temperature strip or plastic strip thermometer). Such sensors contain heat-sensitive (thermochromic) liquid crystals in a strip that change color to indicate different temperatures. Liquid crystals possess the mechanical properties of a liquid, but have the optical properties of a single crystal. Temperature changes can affect the color of a liquid crystal, which makes them useful for temperature measurement. The resolution of liquid crystal sensors may be in the 0.1° C. range. Such sensors do not require a battery and can be attached to the device via an adhesive, e.g. a vinyl adhesive.

Culture medium is often autoclaved to sterilize the media prior to use. The medium must be allowed to cool somewhat before pouring, however, in many cases (e.g. when an agar-containing medium is used), if the medium cools too much the medium begins to solidify and cannot be poured properly. Thus, in some embodiments, the temperature sensor in conjunction with a display monitors the temperature of the media and provides an indication of when the media is at a suitable temperature for pouring. In some embodiments, a suitable temperature is from about 25-50° C., e.g. from about 30-45° C. In some embodiments, the display is a color indicator on a liquid crystal temperature sensor. In some embodiments, the display includes a visual indicator such as LED lights. For example, a green light may be activated when a suitable temperature is detected and a red light may be activated when an unsuitable temperature is detected, e.g. a temperature greater than 50° C. In some embodiments, the display incorporates an auditory signal for conveying the temperature.

Figure 4A:
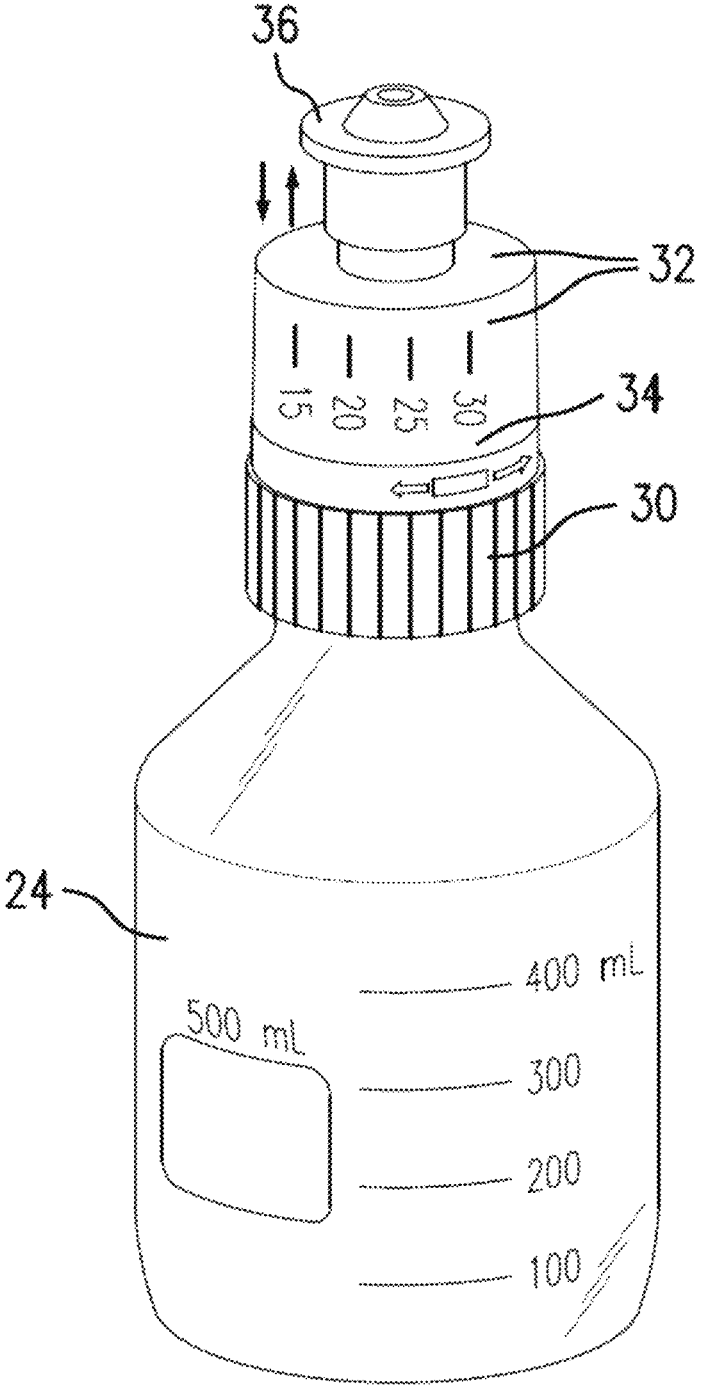
FIG. 4A-B. (A) A dispensing system and a (B) valve according to some embodiments of the disclosure.
Figure 4B:
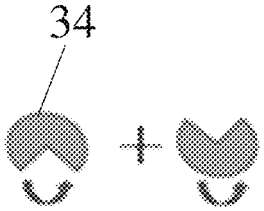

With reference to FIGS. 4A-B, additional embodiments of the disclosure provide a dispensing system that allows for the pouring of predetermined volumes of culture media into petri dishes, thus providing more consistency and accuracy to the cell culture system. In some embodiments, the dispensing system comprises a connector 30 configured for attachment to a neck of a laboratory flask 24, a measuring chamber 32 fluidly connected to the connector 30, a valve 34 arranged between the connector 30 and the measuring chamber 32 configured to releasably seal the fluid contained within the laboratory flask, and an adjustable cap 36 arranged on the chamber 32 at an end opposite the connector 30 configured to releasably seal the fluid contained within the measuring chamber 32. In some embodiments, the length of the dispensing system is 10-30 cm, e.g. 15-20 cm.

An inner surface of the connector may be threaded (a screwcap) to allow for attachment to the neck of the flask. Thus, the connector has a diameter equal to the diameter of standard flask caps depending on the size of the flask.

A valve, e.g. a one way valve, separates the connector and the measuring chamber (FIG. 4B). In some embodiments, pressing or sliding a button or twisting/rotating a switch on the outside of the device opens and closes an opening in the valve. In other embodiments, the valve is a check valve. In some embodiments, the valve is a check valve that does not require any external control (i.e. manual actuation of a button is not required). Suitable check valves include, but are not limited to, vertical check valves, ball check valves, swing check valves, and a stop check valve.

When the valve is closed, liquid contained within the flask cannot enter the measuring chamber. When the valve is opened, the liquid freely enters into the measuring chamber when the flask is tilted. The measuring chamber is provided with horizontal measurement markings so that a user can determine the amount of fluid to be poured as the flask is tilted. When the desired amount is reached, the valve is closed and the adjustable cap at the opposite end of the chamber is opened to allow for the liquid to be dispensed, e.g. into a petri dish. The adjustable cap may be a one way valve made of an autoclavable material, e.g. plastic or polypropylene, that is opened or closed by hand (e.g. a push/pull cap, flip top cap, or pop top cap). An exemplary cap as shown in FIG. 4 is pulled up to open and pushed down to close. In some embodiments, the measuring chamber is configured to contain at least 10 ml of liquid, e.g. at least 15, 20, 25, or 30 ml of liquid, e.g. 15-30 ml of liquid.

Embodiments of the disclosure further provide a method of pouring culture medium or other liquid, comprising placing a flask containing a liquid, such as heated culture medium, into a flask holder as described herein; attaching a dispensing system as described herein to a neck of the flask; when the liquid reaches a predetermined temperature, tilting the flask within the flask holder; opening the valve to allow a predetermined volume of the liquid to enter the measuring chamber; closing the valve; and opening the adjustable cap to pour the predetermined volume of liquid.

Before exemplary embodiments of the present invention are described in greater detail, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

While the invention has been described in terms of its preferred embodiments, those skilled in the art will recognize that the invention can be practiced with modification within the spirit and scope of the appended claims. Accordingly, the present invention should not be limited to the embodiments as described above, but should further include all modifications and equivalents thereof within the spirit and scope of the description provided herein.

We claim:

1. A flask holder, comprising:

a holder portion configured to receive a laboratory flask, wherein the holder portion has an opening at each end such that the holder portion is configured to surround only the sides of the laboratory flask and wherein the holder portion comprises an expandable material and expands to grip sides of the laboratory flask received therein, a frame connected to the holder portion, wherein the frame has a four cornered four sided base which rests on a surface and two arcuate side members connected to a front side and a back side of the four sided base, wherein each of the arcuate side members is connected at two corners of the four cornered four sided base wherein the holder portion is configured to pivot about the frame at a pivot point located at a top of the two arcuate side members such that a liquid may be dispensed from the laboratory flask without moving the frame on the surface on which the four cornered four sided base rests, wherein a space between the front side and the back side of the four cornered four sided base is wider than the holder portion, a tension screw or a holding brake for holding the holder portion at a selected pivot angle relative to the frame at the pivot point for controlling a pouring angle from the laboratory flask, a temperature sensor arranged on the holder portion configured to determine a temperature of a liquid in the laboratory flask, and a display for providing an indication of the temperature of the liquid.

2. The flask holder of claim 1, wherein the expansible material is silicone.

3. The flask holder of claim 1, wherein the frame is formed from metal.

4. The flask holder of claim 1, wherein the temperature sensor is a liquid crystal temperature sensor.

5. The flask holder of claim 1, wherein the display comprises LED lights.

6. The flask holder of claim 1, further comprising a handle arranged on the holder portion to aid a user in tilting the holder portion.

7. The flask holder of claim 1 wherein the temperature sensor is operable without a battery and is attachable to the holder portion using an adhesive.

* * * * *